US011536237B2

(12) United States Patent
Matsinger et al.

(10) Patent No.: US 11,536,237 B2
(45) Date of Patent: Dec. 27, 2022

(54) ENGAGEMENT RELAY FOR AND A METHOD FOR OPERATING AN ELECTRIC MACHINE, PREFERABLY EMBODIED AS A STARTER DEVICE, WITH AN ENGAGEMENT RELAY

(71) Applicants: SEG Automotive Germany GmbH, Stuttgart (DE); DAF Trucks N.V., Eindhoven (NL)

(72) Inventors: Johan Matsinger, Maarheeze (NL); Viktor Bojarkin, Kornwestheim (DE); Oliver Neumann, Heilbronn (DE)

(73) Assignees: SEG AUTOMOTIVE GERMANY GMBH, Stuttgart (DE); DAF TRUCKS N.V., Eindhoven (NL)

( * ) Notice: Subject to any disclaimer, the term of this patent is extended or adjusted under 35 U.S.C. 154(b) by 847 days.

(21) Appl. No.: 16/335,214

(22) PCT Filed: Sep. 19, 2017

(86) PCT No.: PCT/EP2017/073656
§ 371 (c)(1),
(2) Date: Mar. 20, 2019

(87) PCT Pub. No.: WO2018/054909
PCT Pub. Date: Mar. 29, 2018

(65) Prior Publication Data

US 2019/0285043 A1 Sep. 19, 2019

(30) Foreign Application Priority Data

Sep. 20, 2016 (DE) ..... 10 2016 218 032.0

(51) Int. Cl.
*F02N 15/06* (2006.01)
*H01H 51/06* (2006.01)
(Continued)

(52) U.S. Cl.
CPC ..... *F02N 15/067* (2013.01); *F02N 11/087* (2013.01); *F02N 11/0851* (2013.01);
(Continued)

(58) Field of Classification Search
CPC ..... F02N 15/067; H01H 50/20; H01H 50/34; H01H 50/66; H01H 51/065
See application file for complete search history.

(56) References Cited

U.S. PATENT DOCUMENTS

2005/0193841 A1 9/2005 Ahn et al.

FOREIGN PATENT DOCUMENTS

DE 32 39 672 A1 5/1983
DE 69202409 T2 2/1996
(Continued)

OTHER PUBLICATIONS

Search Report of German Patent Application No. 102016201032.0 dated Jan. 24, 2017, 7 pp.
(Continued)

*Primary Examiner* — Ramon M Barrera
(74) *Attorney, Agent, or Firm* — Lathrop GPM LLP

(57) ABSTRACT

The invention relates to an engagement relays (20) for an electric machine which preferably serves as a starter device (10) for engaging a pinion, wherein the engagement relay (20) has a contact device (65) for electrically connecting electrical contacts (120, 121) having a switching axis (67) which can be actuated for the purpose of electrical connection, having a thrust motor (60) which serves to shift the switching axis (67) and the thrust motor (60) has a movable part (57) which serves to activate the switching axis (67), wherein the movable part (57) is connected to a driver (85), wherein a stop part (84) can move relative to the movable part (57) of the thrust motor (60) in a state of rest of the engagement relay (20) there is a gap(s) between the stop part
(Continued)

Figure 1:
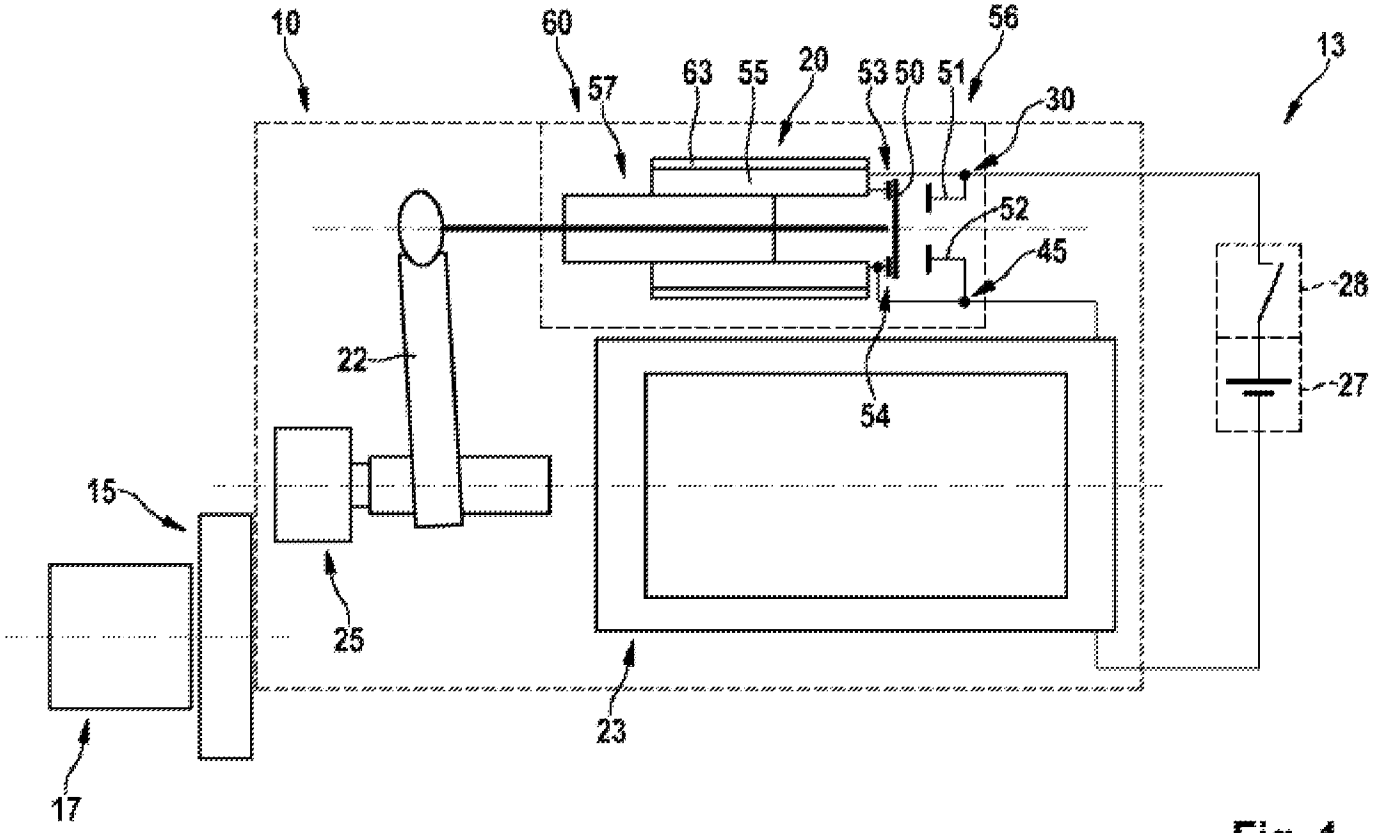

(84) and the driver (85), wherein after the switching of the engagement relay (20) a contact device (65) is activated and as a result a switch of the circuit of the starter motor (23) is closed, wherein a movable part (57) of a thrust motor (60) of the engagement relay (20) I connected to a driver (85) and by means of a switch-on-movement of the movable part (57) the driver (85) brings about an engagement force with an engagement lever (22), in order to mesh a pinion (25) in a toothed ring (15), characterized in that a stop part (84) is arranged between the movable part (57) of the thrust motor (60) and the driver (85), wherein firstly there is a gap(s) with an initial size between the driver (85) and the stop part (84) and when the movable part (57) of the thrust motor (60) moves during switching the gap(s) is made smaller.

15 Claims, 7 Drawing Sheets

(51) Int. Cl.

| | |
|---|---|
| ***F02N 11/08*** | (2006.01) |
| ***H01H 50/20*** | (2006.01) |
| ***H01H 50/34*** | (2006.01) |
| ***H01H 50/66*** | (2006.01) |
| *F02N 11/00* | (2006.01) |

(52) U.S. Cl.
CPC ..... *H01H 50/20* (2013.01); *H01H 50/34* (2013.01); *H01H 50/66* (2013.01); *H01H 51/065* (2013.01); *F02N 11/00* (2013.01)

(56) References Cited

FOREIGN PATENT DOCUMENTS

| | | | |
|---|---|---|---|
| DE | 19727545 | A1 | 1/1999 |
| DE | 102010063091 | A1 | 6/2012 |
| DE | 102011003179 | A1 | 7/2012 |
| EP | 2 288 805 | A2 | 3/2011 |
| FR | 2 174 421 | A5 | 10/1973 |
| GB | 1418396 | | 12/1975 |
| WO | WO2009138624 | | 1/2010 |
| WO | WO 2012101231 | A2 | 8/2012 |

OTHER PUBLICATIONS

International Patent Application No. PCT/EP2017/073656, International Search Report (ISR) and Written Opinion dated Jan. 4, 2018—8 pages (*English translation*).

ENGAGEMENT RELAY FOR AND A METHOD FOR OPERATING AN ELECTRIC MACHINE, PREFERABLY EMBODIED AS A STARTER DEVICE, WITH AN ENGAGEMENT RELAY

CROSS-REFERENCE TO RELATED APPLICATIONS

This application is a 35 U.S.C. § 371 filing of International Application No. PCT/EP2017/073656 filed Sep. 19, 2017, which claims the benefit of priority to German Patent Application No. 10 2016 218 032.0 filed Sep. 20, 2016, each of which is incorporated herein by reference in its entirety.

PRIOR ART

DE 197 27 545 A1 discloses a starter device with an engagement relay in which the movable part of the engagement relay is connected to a driver which is movable relative to the movable part. In this configuration of the engagement relay, it is possible that the pinion touches the front face of the toothed ring of the combustion engine and that a contact device is used to switch on a starter motor of the starter device. In this case, a maximum current may flow through the contact device and therefore through the starter motor while the pinion is still in contact with the toothed ring. The measures of the proposed invention are to achieve a respective improvement.

DISCLOSURE OF THE INVENTION

The advantages of the invention of the engagement relay are that, with the proposed arrangement, a circuit of the contact device of the engagement relay, which is used to turn on a starter motor of the starter device, can only be closed when the pinion is at least partially engaged in the toothed ring of the combustion engine. This removes the risk that the pinion skips a tooth gap in the toothed ring and thus damages the toothed ring or the pinion itself ("ratcheting"). The gap and/or the associated contact of the stop part with the driver mechanically prevents the closing of the contact device to actuate the starter motor when the pinion is not at least partially engaged in the toothed ring. This leads to a so-called "blind circuit" in which for example the ignition starter switch is actuated but the starter or the starter device is not turned on. Consequently, the combustion engine is not started, and a "ratcheting" between the pinion and the toothed wheel is prevented. The respective advantages apply to the claimed method according to the invention as well.

FIGURES

Figure 2:
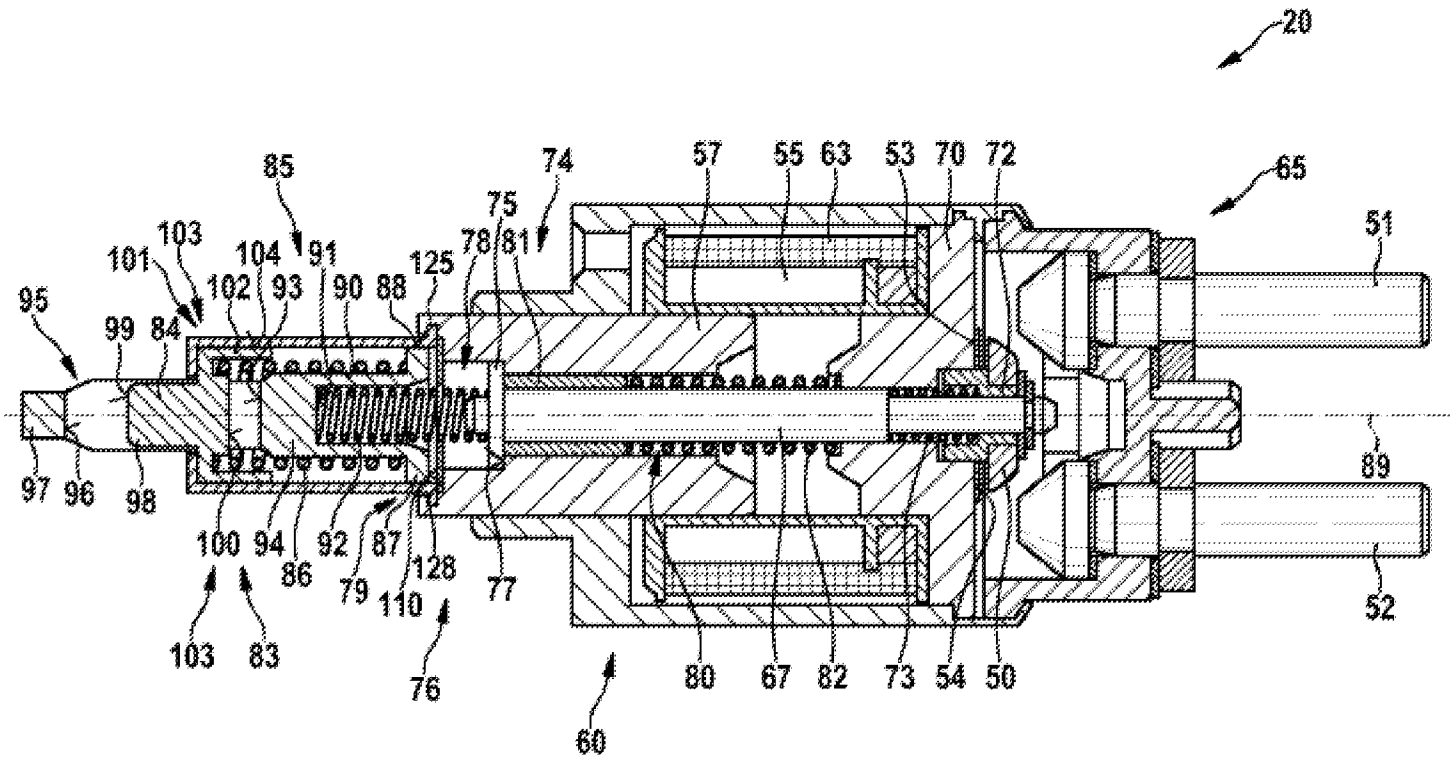

The invention is explained in great detail with the help of various figures:

FIG. 1 shows a schematic view of a starter device with an engagement relay connected to an electrical system of a motor vehicle, FIG. 2 shows an engagement relay in a longitudinal profile, FIGS. 3 to 7 show at least in parts the relay in a longitudinal profile at different movement stages.

The same components are identified with the same reference signs.

FIG. 1 schematically presents a view of a starter device 10 with a portion of an electrical system 13. The bottom left of FIG. 1 shows sections of a toothed ring 15 of a combustion engine 17 as well. The starter device 10 has an engagement relay 20, an engagement lever 22, a starter motor 23, as well as a pinion 25. The part of the electrical system represented in FIG. 1 shows a power supply 27, typically referred to as the starter battery, and a starter switch 28. The electrical circuit shown in FIG. 1 shows the electrical circuit or current path through which the starter device 10 is supplied with electric energy. To this purpose, the engagement relay 20 is connected to a plus pole of the power supply 27 by means of a so-called terminal 30. The current then enters the starter motor 23 by means of a so-called terminal 45. To this purpose, the engagement relay 20 is switched on or activate to move a contact bridge 50 toward a so-called positive pole 51 and a negative pole 52. When the starter switch 28 is closed, current flows to the starter motor 23 via the positive pole 51, the contact bridge 50, and the negative pole 52 and then drives this motor at its full force. As the starter switch 28 is turned on and before the contact bridge 50 is activated or moved, the contact bridge 50 or alternatively a similar contact causes two auxiliary contacts 53 and/or 54 to be connected in an electrically conductive manner. This causes current to flow to the pull-in winding 55. As long as the contact bridge 50 or the other auxiliary contact, which is not further specified, does not open this electrical connection with the pull-in winding 55, the pull-in winding 55 pulls a movable part 57, which may be configured for example as a so-called keeper, into the pull-in winding 55. It is also mentioned that, in order to operate the contact bridge 50, this engagement relay 20 comprises an apparatus referred to here as a thrust motor 60 with the movable part 57 which, as the pull-in winding 55 and also a hold-in winding 63 are supplied with current, develops a force that makes it possible to move the contact bridge 50 by means of the movable part 57, preferably configured as a keeper, against various resistances (such as springs).

FIG. 2 represents a more specific exemplary embodiment of the engagement relay 20 with the thrust motor 60 in a starting position. The right side of FIG. 2 shows a contact device 65 which comprises the contact bridge 50, the positive pole 51, and the negative pole 52. In this case, it also comprises an auxiliary contact 53 and an auxiliary contact 54. As already mentioned, these auxiliary contacts 53, 54 serve to supply current to a pull-in winding 55 after the starter switch 28 has been closed. The contact bridge 50 sits on a switching axis 67 which passes through a magnetic return circuit 70. The contact bridge 50 rests on an insulation sleeve 72. The insulation sleeve 72 is inserted into and guided through a cylindrical recess in the magnetic return circuit 70. In a recess that is at the back of the contact bridge 50, and which is not described in further detail here, a contact pressure spring 73 rests at its left end, therefore at an end that faces away from the contact bridge 50, on a shoulder of the switching axis 67, which is not described in further detail here either.

A stop part 75 rests on a pin 76 with a reduced diameter at an end 74 of the switching axis 67 which faces away from the contact bridge 50. The stop part 75, preferably configured as a simple perforated plate, rests with a surface pointing toward the contact bridge 50 on a base 77 of a blind hole-type recess 78. The blind hole-type recess 78 is inserted at one end 79 of the movable part 57. This end 79 faces away from the contact bridge 50. Starting from the base 77, the movable part 57 has an opening 80 created in the manner of a through bore. The switching axis 67 is positioned in this opening 80 by means of a slide bush 81. A contact reset spring 82 rests on a front face of the slide bush 81, which is not further specified, but which faces the contact bridge 50.

At another end of the contact reset spring 82, the spring rests on the magnetic return circuit 70. A guide element 83, which is preferably configured as a socket, connects to the end 79 of the movable part 57. This guide element 83 is firmly attached at its end that points toward the movable part 57. A stop part 84 and a driver 85 are arranged in this guide element 83. The stop part 84 and the driver 85 are kept apart by a spring 86, which is a pressure spring in this example, and by a force applied by this spring 86.

The driver 85 is configured as follows: A section 87, which is particularly preferred and configured here for example as an annular collar, is provided at the side that faces the movable part 57. This section 87 has an outer circumference with a radially outward-pointing surface 88. This radially outward-pointing surface 88 guides the driver 85 in the guide element 83. This allows for a precise guidance of the driver 85 in the guide element 83 in the direction of an axis 89, which corresponds to a given direction during switching and therefore the movement of the contact bridge 50 and the movement of the movable part 57. The driver 85 comprises a section 90 in a direction that faces away from the movable part 57 and that has a cylindrical ring configuration in a particularly preferred embodiment. A preferably circular front face 91 is found at the end of section 90 which is furthest away from the movable part 57. A reset spring 92 extends between this front face 91 and a front face of the stop part 75, which is preferably configured here as a pressure spring. There is a connection section 94 between the front face 91 and a further front face 93. A slot 95 in the driver 85, which is preferably designed as a longitudinal slot, is located in the direction that faces away from the movable part 57. There is another front face 96 in the direction that faces away from the movable part 57, so that the slot 95 extends in the direction of the axis 89 between the two front faces 93 and 96. The front face 96 is followed by an end section 97, which preferably joins side parts of the slot 95 to form one piece at this location. The driver 85 therefore comprises the section 87 as an annular collar, the section 90, the connection section 94, the side parts of the slot 95 and the end section 97.

In an especially preferred embodiment, the stop part 84 is configured in a disk-shaped manner. It has a preferably disk-shaped pin part 98 which, in the direction of the axis 89 and facing the front face 96, comprises a front face 99 itself. Also pointing in the direction of the axis 89 and in this case pointing toward the front face 93, the pin part 98 has a further front face 100. This means that the pin part 98 extends in an especially preferred embodiment between the two front faces 99 and 100. At the end that points in the direction of the contact bridge 50, the pin part 98 is guided in the guide element 83 by means of a guidance device 101 in such a way that the stop part 84 performs a preferably exclusive axial movement in the direction of the axis 89. As an especially preferred embodiment, the guidance device 101 has two arms 102 that start at the pin part 98. Each of the two arms 102 comprises a guidance section 103 which extends in the direction of the axis 89 in a rod-like manner. These guidance sections 103 comprise a surface 104 that points away from the axis 89, i.e., that is aimed radially outward from there, by means of which the stop part 84 is guided in the guide element 83 in such a way that this stop part 84 is movably guided in the direction of the axis 89 in this manner. A section of the engagement lever 22 engages in the slot 95, i.e., between the front faces 96 and 99, when the engagement relay is installed. By means of a preferably chosen installation position of the engagement relay 20 relative to a housing of the starter device 10, the driver 85 lifts the section 87 off a stop part 110 when the engagement lever 22 is inserted in the slot 95 (distance w not equal to zero).

Figure 3:
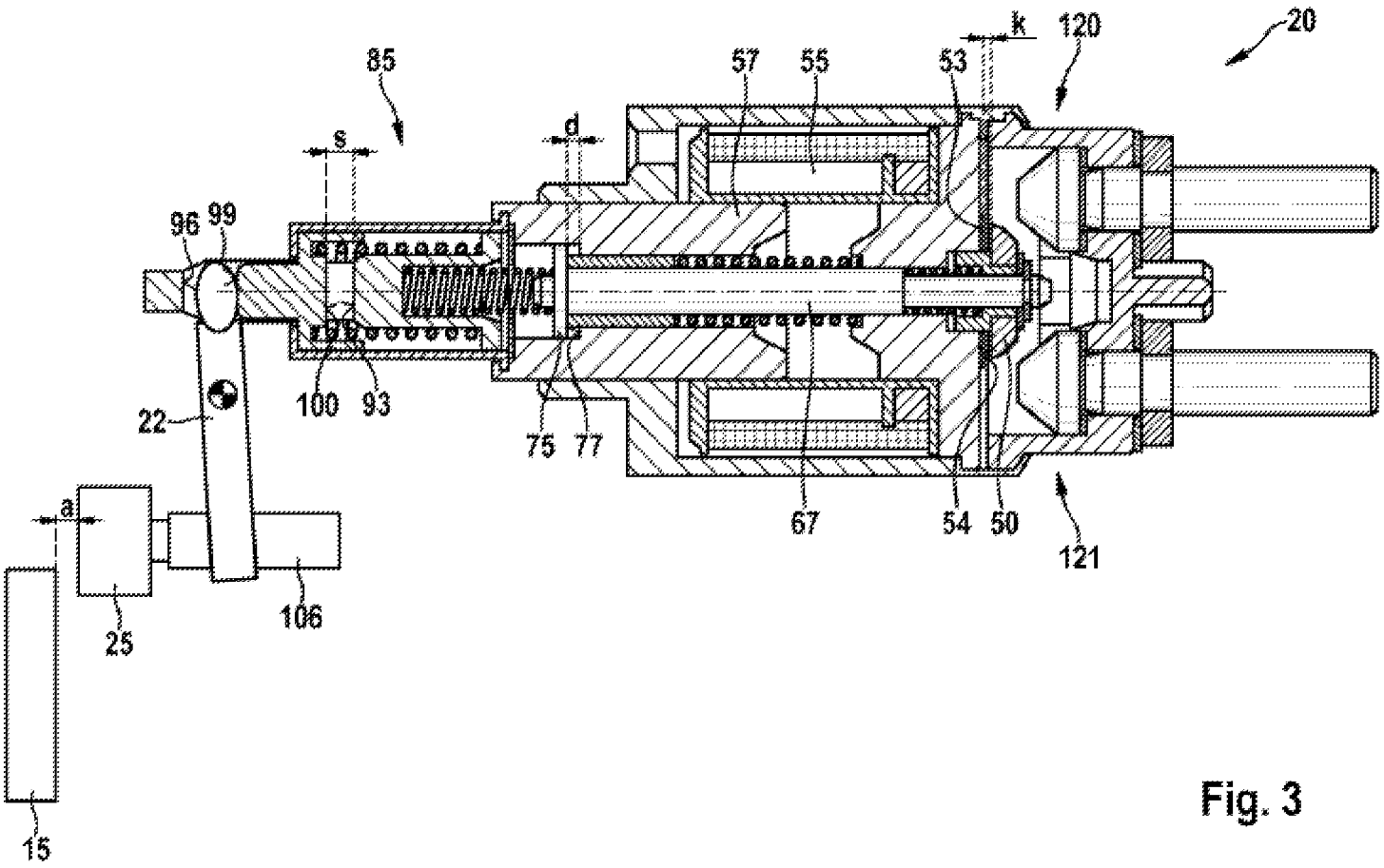

While FIG. 2 shows the resting position of the engagement lever 20, FIG. 3 shows the engagement relay 20 shortly after the engagement relay 20 has been turned on with an already slightly changed position of the movable part 57. As can be seen well here in the representation shown in FIG. 3, the stop part 75 is already slightly lifted off the surface and/or the base 77 of the movable part 57 with its surface pointing toward the contact bridge 50. Accordingly, there is a distance d between the stop part 75 and the base 77. The situation depicted in this figure is intended to show a situation of the mechanics in the engagement relay 20 or in the starter or the starter device 10, respectively, in which all so-called slack, i.e., axial play, in the starter device 10 or the engagement relay 20 is used up in the time prior to the immediately pending movement of the pinion 25. This type of slack may be or is for example a distance between the front face 99 and an upper end of the engagement lever 22. Furthermore, there may be slack that can occur between the engagement lever 22 and a pinion shaft 106. In this situation, a gap s between the front faces 100 and 93 is preferably still the same size it had during the resting position according to FIG. 2. A distance a still corresponds to a distance between the toothed ring 15 and the pinion 25 when in rest. A distance k, which exists between a contact bridge 50 and the auxiliary contacts 53, 54, is still zero here. This means that current flows through the pull-in winding 55.

What is disclosed therefore is an engagement relay 20 for an electric machine which preferably serves as a starter device 10 that engages a pinion 25. The engagement relay 20 comprises a contact device 65 for connecting electrical contacts 120, 121. The electrical contact 120 is connected in particular to a positive pole 51 and the electrical contact 121 to a negative pole 52. There is a switching axis 67 that must be actuated to create the electrical connection. The engagement relay has a thrust motor 60 which moves the switching axis 67. The thrust motor 60 has a movable part 57 which is preferably configured as a keeper. Accordingly, the thrust motor 60 is configured for example as a so-called solenoid. The movable part 57 actuates the switching axis 67. The movable part 57 is connected to a driver 85. A stop part 84 is movable relative to the movable part 57 of the thrust motor 60, and in a resting state of the engagement relay 20, there is a gap s between the stop part 84 and the driver 85. A spring 86 keeps the stop part 84 and the driver 85 apart. What is provided in particular is that a pressure spring is arranged between the stop part 84 and the driver 85. This means that what is provided in particular is that the spring 86 is configured as a pressure spring. It is also provided that the stop part 84 and the driver 85 are guided relative to each other. It is provided in particular that the stop part 84 and the driver 85 are directly guided relative to each other. The guiding of the stop part 84 relative to the driver 85 is possible because the stop part 84 is guided with the pin part 98 in the slot 95 of the driver 85. The pin part 98 is formed in a plate-like manner and can therefore be easily guided in the slot 95 with the plate-like surfaces of the pin part 98. This means that the stop part 84, which sits in the slot 95, almost cannot be rotated around the axis 89. In an especially preferred embodiment, only some rotational play is possible to prevent an unintended blockage between the two parts. Accordingly, it is provided that a pin part 98, which is, in particular, formed in a plate-like manner, engages in a slot 95 of the driver 85 and thus causes the stop part 84 and the driver 85 to be guided relative to each other. It is provided in particular that the stop part 84 comprises a surface 104 that points in a radial outward direction with the stop part 84 being guided in the guide element 83 by means of this surface 104. The driver 85 that interacts with the stop part 84 has a section 87 which is, in particular, formed as an annular collar with a radially outward-facing surface 88 and with the driver 85 being guided with this surface 88 in the guide element 83. It is provided in particular that the driver 85 has a collar-like section 87 and that the switching axis 67 has a stop part 75, in particular at its end directed at the driver 85. It is also provided that a further stop part 110 is arranged between the collar-like section 87 and the stop part 75 which, when in the resting state, in particular of the noninstalled engagement relay 20, acts as a stop for the collar-like section 87 and in the switching state a stop for the further stop part 75, in particular of the switching axis 67. It is furthermore provided that further stop parts 110 are held between the guide element 83, in particular a collar 125, the guide element 83 formed as a socket, and a front face 128 of the movable part 57. Furthermore provided is a starter device 10 with an engagement relay 20 according to one of the exemplary embodiments described above.

Figure 4:
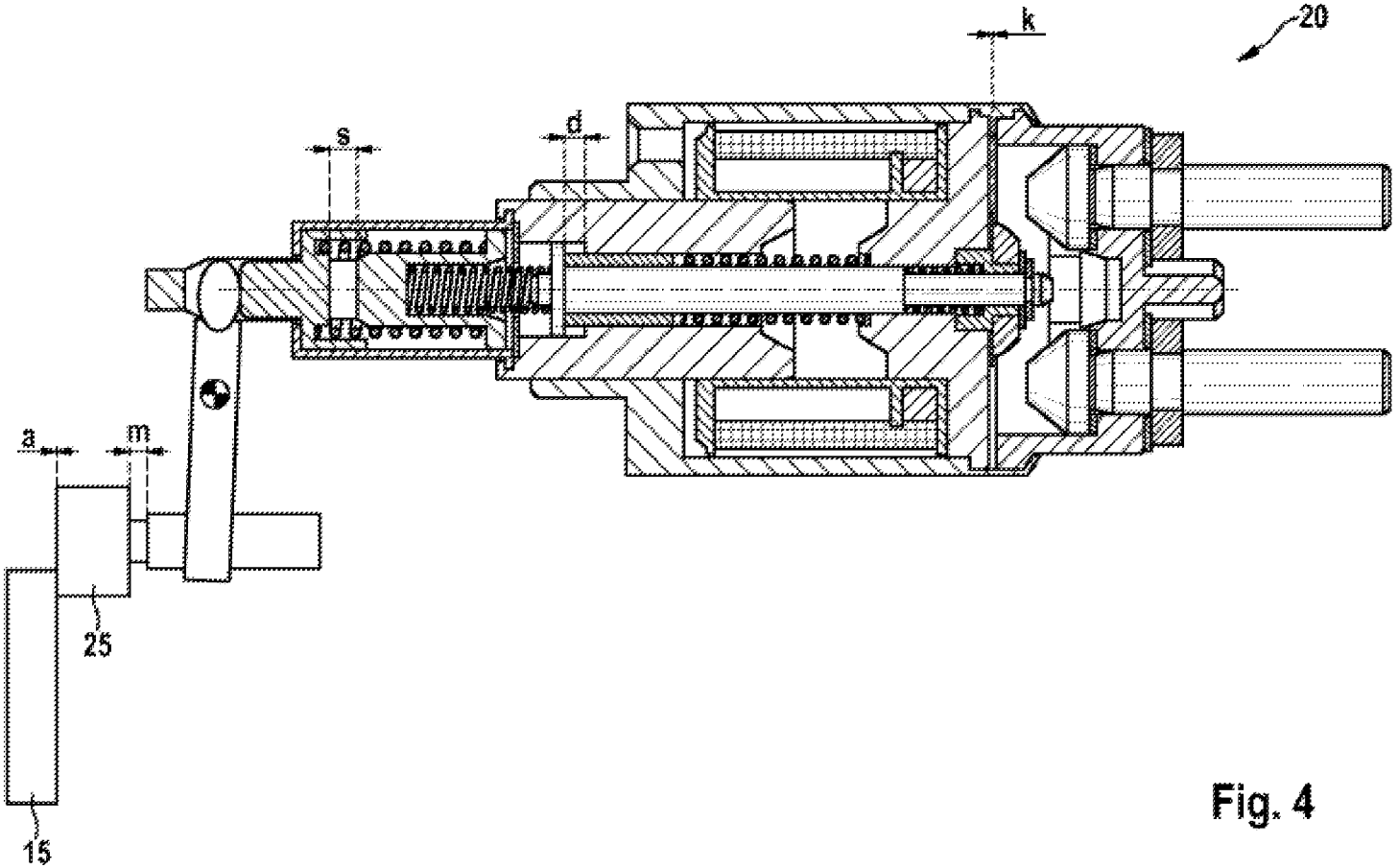
Figure 5:
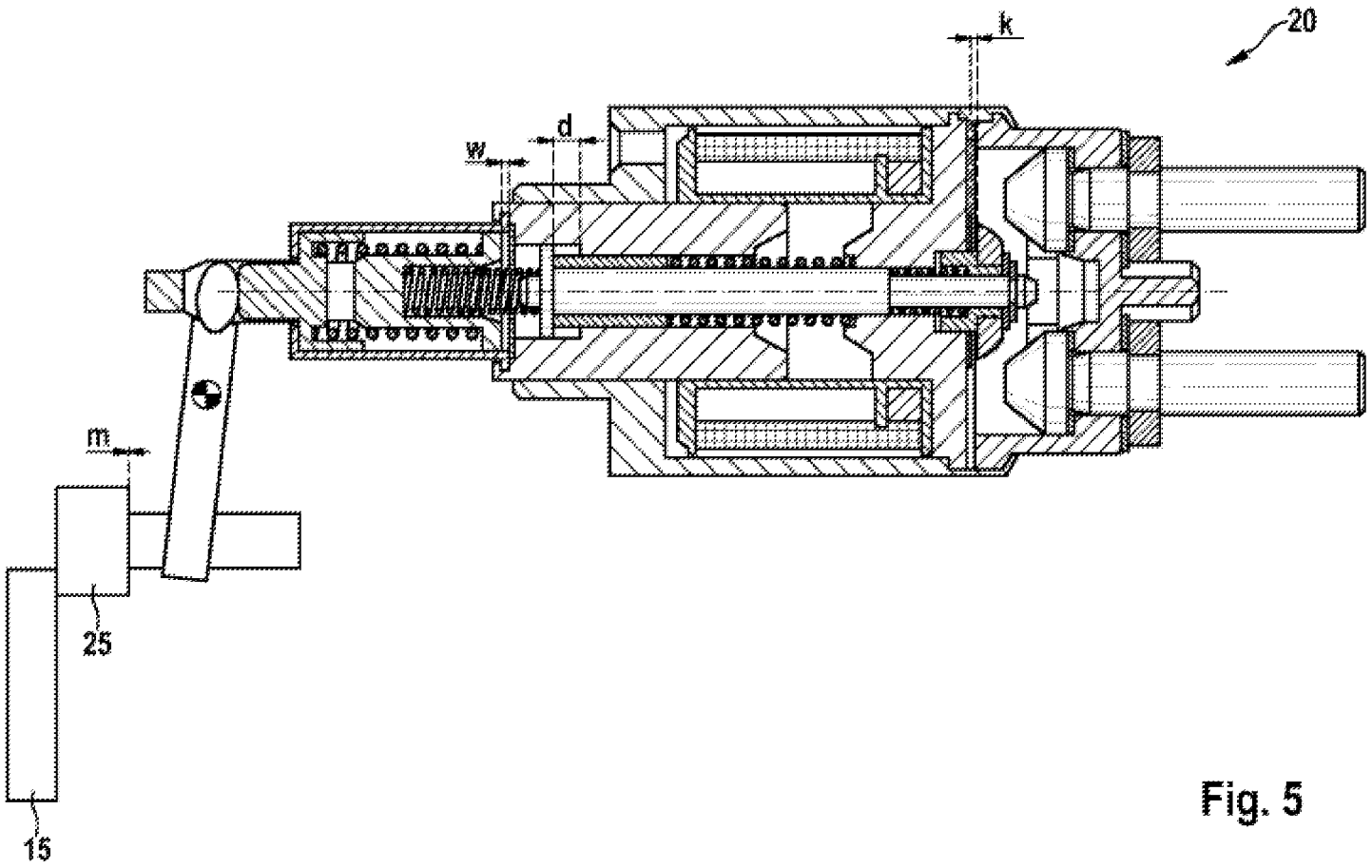
Figure 6:
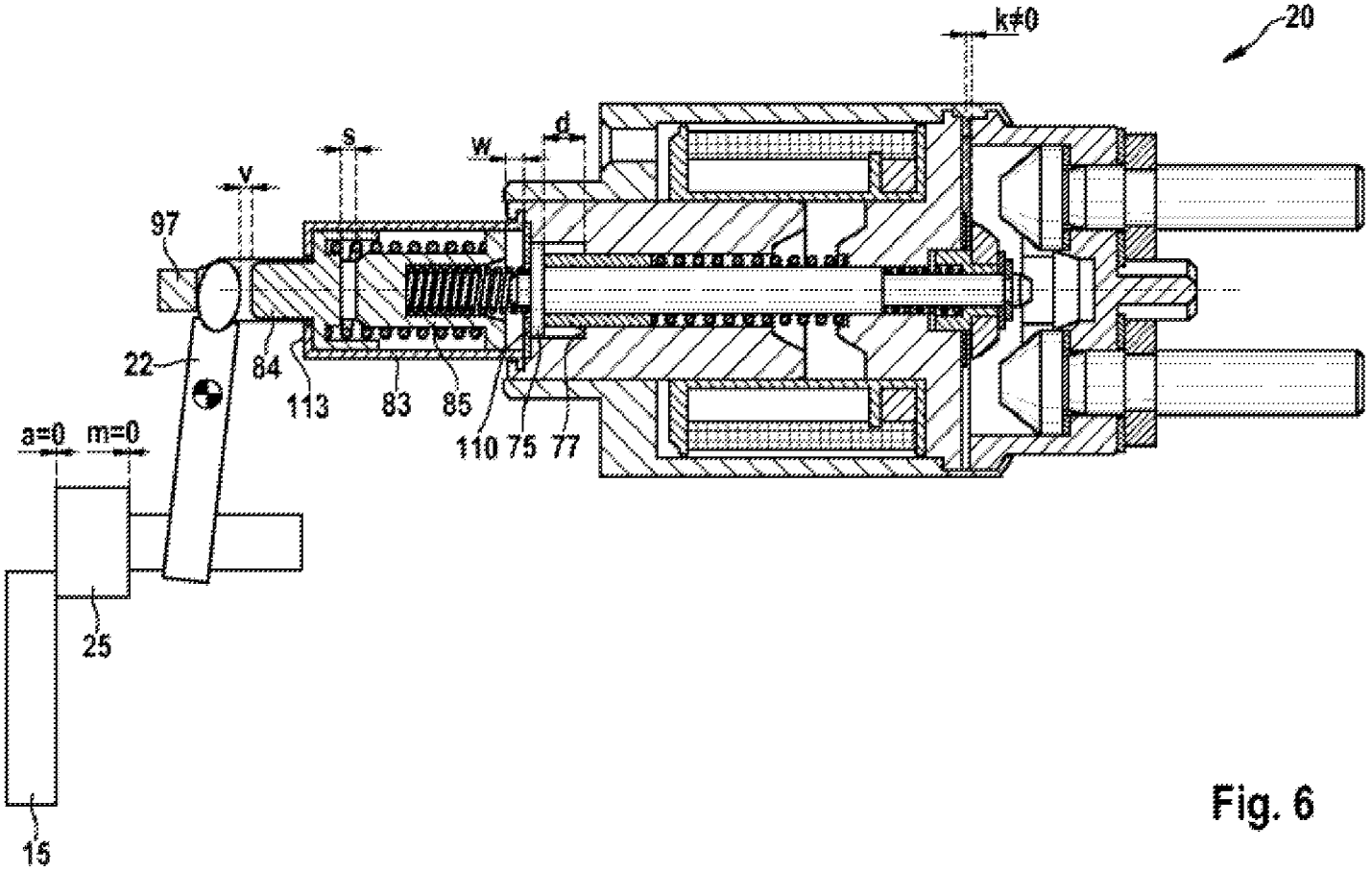

FIG. 4 shows the engagement relay 20 in the starter device 10 in a situation in which a distance a between the pinion 25 and the toothed ring 15 has become zero. It is preferred that the distances s and k are unchanged, i.e., that for k the distance is basically zero, as shown in FIG. 3 as well, because the contact bridge 50 is in contact with the auxiliary contacts 53, 54. In this regard, the depictions of the distance k in FIG. 3 and FIG. 4 are symbolic. In the event a pinion 25 is formed as a so-called push-on pinion, as is the case in the exemplary embodiment but not necessarily required, there is a further distance m which identifies a so-called push-on pinion path. It becomes clear in particular in connection with FIG. 5 that while the pinion 25 is in contact with the toothed ring 15, the push-on pinion path m is used up, i.e., becomes zero, as the movable part 57 is moved further into the engagement relay 20. In this context, the distance d increases as well. The distance k continues to be zero.

As already mentioned, the pull-in winding 55 is under current after the start switch 28 has been turned on. Since the starter motor 23 is arranged in the current path of the pull-in winding 55 and the current is so strong that the starter motor 23 turns, a pinion 25 ultimately turns as well. This also means that the stop part 110 according to the illustration in FIG. 6 pushes on the stop part 75. The distance d therefore has reached its maximum. Furthermore, the distance or gap s between the two front faces 93 and/or 100 has now decreased. As the distance w increases or when a distance w arises, there is now also a gap or distance k that is not equal to zero. Accordingly, due to the dynamic of the movable parts in the engagement relay 20, the gap s is now smaller compared to the previous states shown in FIGS. 2 to 5 as well. This means that the driver 85, compared to the situation shown in FIG. 5, did not change its position, because the distances a and/or m did not change, and that the end section 97 rests unchanged with its front face 96 on the upper end of the engagement level 22. As the movable part 57 and therefore the respectively immovably connected guide element 83 as well as a radial collar 113 on the guide element 83, which takes the stop part 84 along, are pulled in, a distance v between the upper end of the engagement lever 22 and the stop part 84 decreases due to the ability to relatively move the stop part 84 against the driver 85 in an axial manner. The distance k is now so great that the contact bridge 50 interrupts the electrical connection with the pull-in winding 55.

What is therefore disclosed is a method for operating an electric machine formed in particular as a starter device 10 with an electric starter motor 23 and with an engagement relay 20 wherein, after the engagement relay 20 has been turned on, a contact device 65 is to be actuated which closes a switch of the circuit of the starter motor 23 to be closed, wherein a movable part 57 of a thrust motor 60 of the engagement relay 20 is connected with a driver 85, and causes through a switching motion of the movable part 57 of the driver 85 on an engagement lever 22 an engagement force to engage a pinion 25 in a toothed ring 15, wherein a stop part 84 is arranged between the movable part 57 of the thrust motor 60 and the driver 85, with a gap s with a starting size being initially present between the driver 85 and the stop part 84, with the gap s decreasing as the movable part 57 of the thrust motor 60 is moved during switching. During the movement of the movable part 57 of the thrust motor 60 for actuation purposes, the gap s is decreased so that the driver 85 comes in contact with the stop part 84. This means one of the teeth of the pinion 25 comes in contact with one of the teeth of the toothed ring 15 and that the gap s subsequently decreases. A pull-in winding 55 of the thrust motor 60 is under current. By putting the pull-in winding 55 under current, the starter motor 23 that is connected in series to this pull-in winding 55 is put under current and the pinion 25 starts rotating accordingly. During the movement of the movable part 57 of the thrust motor 60, a switching axis 67 is displaced during switching with an initially closed switch 56 being opened to put a pull-in winding 55 under current. The gap s is decreased against a spring force of a spring 86 between the stop part 84 and the driver 85. As the pinion 25 comes in contact with the toothed ring 15, the movable part 57 of the thrust motor 60 is prevented from any further movement, thereby initially stopping any further movement of the switching axis 67 and a closing of the contact device 65.

Figure 7:
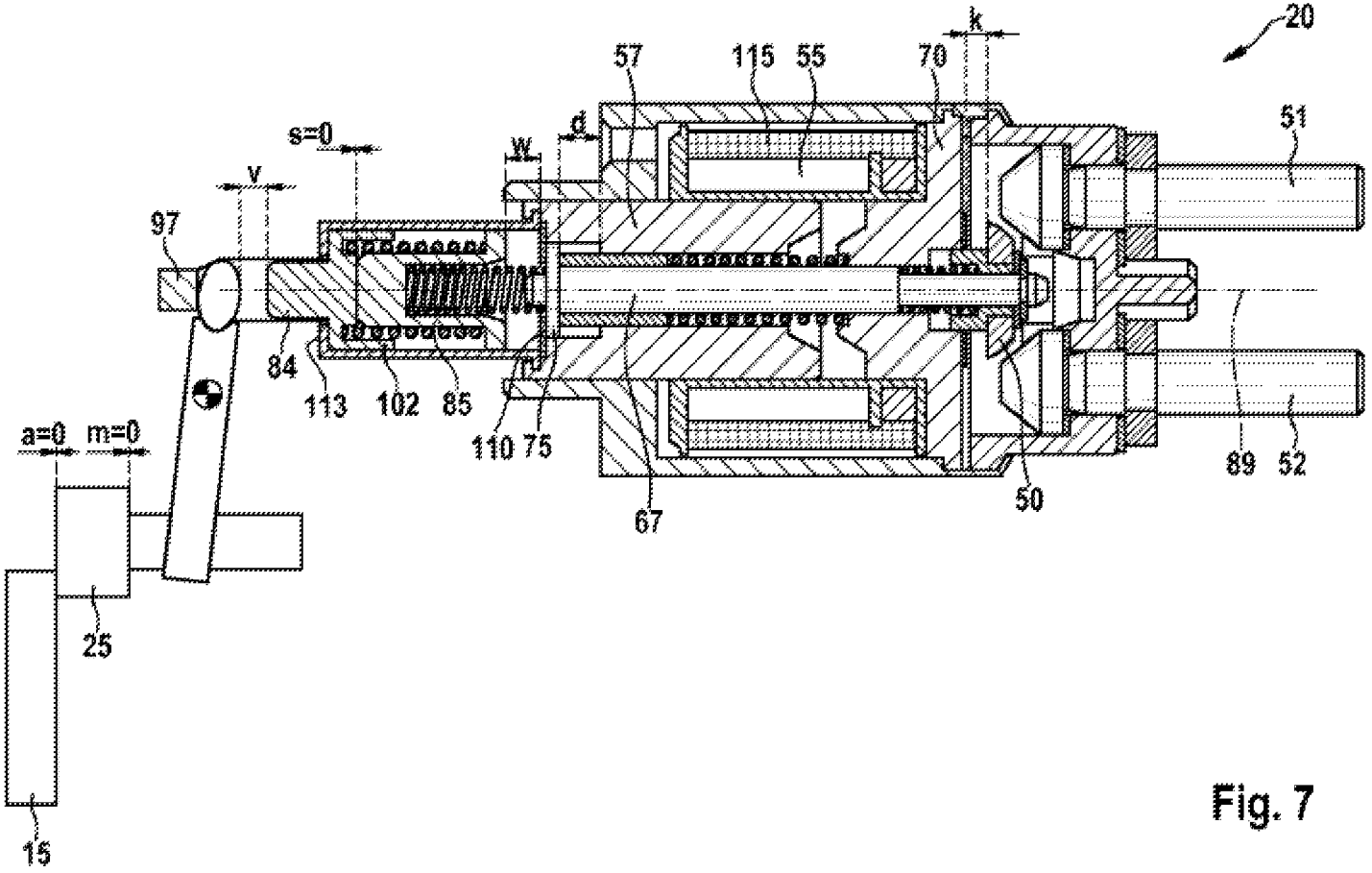

FIG. 7 shows another state of the engagement relay 20 or the starter device 10 respectively. This state follows the state shown in FIG. 6. The distances a and m continue to be zero. As the movable part 57 continues to be pulled in or remains pulled in at a now constant distance d, the distance k increases. In other words, the distance between the contact bridge 50 and the contact surface of the positive pole 51 or the contact surface of the negative pole 52 decreases. As shown, the gap s is now zero as well; i.e., the distance between the stop part 84 and the driver 85 cannot be reduced any further. The distance v in this situation therefore cannot be increased further either. This applies to the distance w as well. If, in this situation, teeth of the pinion 25 are engaged with teeth of the toothed ring 15 in a so-called tooth-on-tooth position, no further movement of the pinion 25 in the toothed ring 15 is possible. Due to the size of the gap s, i.e., its minimum size zero, no further pull-in movement of the movable part 57 is possible any longer. This is the case because, due to a certain forced situation between the toothed ring 15 and the pinion 25 (tooth-on-tooth position), the play that is used up between the upper end of the engagement lever 22 and the end section 97 makes any further movement of the driver 85 in the direction of the axis 89 impossible here as well. This prevents any further displacement of the stop part 84, and, due to the interaction with the radial collar 113, which cannot be moved by means of the guide element 83, no further movement will be possible in this system due to the tooth-on-tooth position as long as said position is maintained. This means that because the driver 85 prevents a progressing movement of the movable part 57 by means of the guide element 83 and the radial collar 113 as well as the arms 102, the stop part 110 is unable to move the stop part 75 further in the direction of the axis 89. This means that the switching axis 67 cannot be pushed forward any further and, accordingly, the contact bridge 50 initially comes to a halt before coming in contact with the positive pole 51 and the negative pole 52. A stop part 75 arranged on the switching axis 67 is thus applied to the stop part 110 on the movable part 57 of the thrust motor 60. Before or after the stop part 75 arranged on switching axis 67 on the stop part 110 is applied to the movable part 57 of the thrust motor 60, the driver 85 is removed from the stop part 110 on the movable part 57 of the thrust motor 60, which increases a spring force of the spring 86 between the stop part 84 and the driver 85.

The situation shown in FIG. 7 is then maintained as long as the tooth-on-tooth position is maintained between the pinion 25 and the toothed ring 15. As mentioned before, the starter motor 23 is put under current by the current that flows through the pull-in winding 55 at the beginning of the process, because the pull-in winding 55 is switched in series to the starter motor 23. If this starter motor 23 is under so much current that it turns strongly enough even after the power supply of the pull-in winding 55 is interrupted (inertia), it is possible that this drive turns the pinion 25 far enough that a tooth-gap situation arises between the pinion 25 and the toothed ring 15. Due to the engagement force that acts on the pinion 25, caused by a hold-in winding 115, which is put under current in the typical manner when the engagement relay 20 is turned on, the pinion 25 is thus further pushed into the toothed ring 15 in a situation in which the contact bridge 50 did not close the main current path to the starter motor 23. One tooth of the turning pinion 25 engaging between two teeth of the toothed ring 15. This explains the advantage of this device and the method associated with it because, here, it is not possible for the main current path for the starter motor 23 to make contact without an at least partial engagement of the teeth of the pinion 25 with the toothed ring 15.

If, against all expectations, a dynamic of the starter motor 23 based on the current provided by the pull-in winding 55 is insufficient due to some resistances in the system, meaning that if the starter motor 23 does not turn at a sufficiently high speed and/or not long enough after the pull-in winding 55 has been shut off, the rotatory energy typically stored in the rotor and a potential planetary gear between the pinion 25 and the starter motor 23 is not great enough to overcome resistance of a mechanical type between the pinion 25 and its teeth and the teeth of the toothed ring 15 and is therefore not able to overcome the tooth-on-tooth position between the pinion 25 and the toothed ring 15. In such a case, a so-called "blind circuit" occurs in the starter device 10, which means that the starter switch 28 was actuated (starter device 10 turned on) but that it was not possible for the pinion 25 to engage in the toothed ring 15. Accordingly, the starter device 10 must be turned off in this situation so that a hold-in winding 115 is turned off and does not overheat. It may be turned off either manually by the driver (manual opening of the starter switch 28) or by a controller, which is not further specified or shown here, which detects this situation (no engagement of the pinion 25 with the toothed ring 15) and then automatically opens the circuit to the starter device 10, for example after a certain period of time, temperature of a winding such as a hold-in winding 115.

If, otherwise, the pinion 25 did engage with the toothed ring 15, the upper end of the engagement lever 22 allows for a further movement of the end section 97 so that it is able to move further in the direction of the axis 89—in this case to the right and/or in the direction of the contact bridge 50. The associated displacement of the driver 85 in the direction of the contact bridge 50 leads, due to the current in the hold-in winding 115 and the magnetic field that therefore acts on the movable part 57 and the associated pull-in force in the direction of the magnetic return circuit 70, to a compressive force in the direction of the contact bridge 50 on the radial collar 113 and therefore also on the front face of the retaining arms 102. This means that the stop part 84 directly follows the further movement of the driver 85. Accordingly, due to the continued movement of the movable part 57, a continued movement of the stop part 110 is possible so that a force continues to act on the stop part 75 and therefore also on the switching axis 67 which acts in the direction of the contact bridge 50. Finally, the contact bridge 50 will touch the contact surface of the positive pole 51 and the negative pole 52, thereby closing the main current path through the starter motor 23. The movable part 57 of the thrust motor 60 is therefore moved away, thereby closing the switch of the circuit of the starter motor 23. The starter motor 23 will then drive the pinion 25 at maximum power and the starting sequence of the combustion engine 17 may occur.

The invention claimed is:

1. Engagement relay (20) for an electric machine, with the engagement relay (20) comprising a contact device (65) for the electrical connection of electrical contacts (120, 121), with a switching axis (67) which must be actuated for the electrical connection, with a thrust motor (60), which serves to displace the switching axis (67) and with the thrust motor (60) comprising a movable part (57), which serves to actuate the switching axis (67), the movable part (57) being connected with a driver (85), wherein a stop part (84) is movable relative to the movable part (57) of the thrust motor (60) and has a gap (s) between the stop part (84) and the driver (85) when the engagement relay (20) is in a state of rest, wherein a pin part (98) of the stop part (84) engages in a slot (95) of the driver (85), wherein the slot (95) extends between two end faces (93, 96) of the slot (95), and thereby guiding the stop part (84) and the driver (85) relative to each other.

2. Engagement relay according to claim 1, characterized in that a spring (86) keeps the stop part (84) and the driver (85) apart.

3. Engagement relay according to claim 1, characterized in that the stop part (84) comprises a surface (104) that points in the radial outward direction and is guided with the same in a guide element (83).

4. Engagement relay according to claim 3, characterized in that the driver (85) comprises a surface (88) that points in the radial outward direction and is guided with the same in the guide element (83).

5. Engagement relay according to claim 1, characterized in that the driver (85) has a collar-like section (87) and the switching axis (67) has a stop part (75), and that another stop part (110) is arranged between the collar-like section (87) and the stop part (75) which, when in the resting state, is a stop for the collar-like section (87) and in the switching state a stop for the further stop part (75).

6. Engagement relay according to claim 5, characterized in that the further stop part (110) is held between the guide element (83), in particular a collar (125) of the guide element (83) being formed as a socket, and a front face (128) of the movable part (57).

7. Starter device (10) with an engagement relay (20) according to claim 1.

8. Engagement relay (20) for an electric machine, with the engagement relay (20) comprising a contact device (65) for the electrical connection of electrical contacts (120, 121), with a switching axis (67) which must be actuated for the electrical connection, with a thrust motor (60), which serves to displace the switching axis (67) and with the thrust motor (60) comprising a movable part (57), which serves to actuate the switching axis (67), the movable part (57) being connected with a driver (85), wherein a stop part (84) is movable relative to the movable part (57) of the thrust motor (60) and has a gap (s) between the stop part (84) and the driver (85) when the engagement relay (20) is in a state of rest, wherein the driver (85) has a collar-like section (87) and the switching axis (67) has a stop part (75), and that another stop part (110) is arranged between the collar-like section (87) and the stop part (75) which, when in the resting state, is a stop for the collar-like section (87) and in the switching state a stop for the further stop part (75).

9. Engagement relay according to claim 8, characterized in that a spring (86) keeps the stop part (84) and the driver (85) apart.

10. Engagement relay according to claim 8, characterized in that the stop part (84) and the driver (85) are guided relative to each other.

11. Engagement relay according to claim 8, characterized in that a pin part (98) engages in a slot (95), thereby guiding the stop part (84) and the driver (85) relative to each other.

12. Engagement relay according to claim 8, characterized in that the stop part (84) comprises a surface (104) that points in the radial outward direction and is guided with the same in a guide element (83).

13. Engagement relay according to claim 12, characterized in that the driver (85) comprises a surface (88) that points in the radial outward direction and is guided with the same in the guide element (83).

14. Engagement relay according to claim 8, characterized in that the further stop part (110) is held between the guide element (83), in particular a collar (125) of the guide element (83) being formed as a socket, and a front face (128) of the movable part (57).

15. Starter device (10) with an engagement relay (20) according to claim 8.

* * * * *